US006640513B2

(12) United States Patent
Ku

(10) Patent No.: US 6,640,513 B2
(45) Date of Patent: Nov. 4, 2003

(54) COMBINATION FLOOR STRUCTURE

(76) Inventor: Chen Chung Ku, No. 52, Lane 213, Yungkang Rd., Fengyuan City, Taichung (TW), 420

( * ) Notice: Subject to any disclaimer, the term of this patent is extended or adjusted under 35 U.S.C. 154(b) by 76 days.

(21) Appl. No.: 10/051,149

(22) Filed: Jan. 22, 2002

(65) Prior Publication Data

US 2003/0136074 A1 Jul. 24, 2003

(51) Int. Cl.[7] ..... E04B 1/38

(52) U.S. Cl. ..... 52/589.1; 52/392; 52/582.1; 52/177; 404/40

(58) Field of Search ..... 52/392, 582.1, 52/592.2, 589.1, 177, 384; 404/34, 35, 37, 40, 47

(56) References Cited

U.S. PATENT DOCUMENTS 719,790 A * 2/1903 Gregory ..... 404/42
748,746 A * 1/1904 Kelsey ..... 52/509
1,614,127 A * 1/1927 Heppes ..... 52/311.2
1,747,295 A * 2/1930 Goldsmith ..... 52/323
1,888,937 A * 11/1932 Saives ..... 404/40
3,824,644 A * 7/1974 Stranzinger ..... 14/27
4,430,837 A * 2/1984 Kirschenbaum ..... 52/506.05
4,604,962 A * 8/1986 Guibault ..... 114/266
5,409,325 A * 4/1995 Wu ..... 404/34
5,640,821 A * 6/1997 Koch ..... 52/698

* cited by examiner

*Primary Examiner*—Carl D. Friedman
*Assistant Examiner*—Basil Katcheves
(74) *Attorney, Agent, or Firm*—Rosenberg, Klein & Lee

(57) ABSTRACT

A combination floor structure includes multiple main boards, and multiple connecting boards. Each of the main boards is a rectangular plate, and has four corners each formed with a recessed portion which has a central position protruded with a locking lug which has a center formed with a locking recess. Each of the connecting boards has an outer periphery formed with multiple connecting recesses each of which may allow insertion of the locking lug of the main board, so as to lock and position the locking lug of the main board. Each of the connecting recesses has a center protruded with a connecting lug that may be inserted into and locked in the locking recess of the main board.

9 Claims, 4 Drawing Sheets

COMBINATION FLOOR STRUCTURE

BACKGROUND OF THE INVENTION

1. Field of the Invention

The present invention relates to a combination floor structure, and more particularly to a combination floor structure that may have variations of various shapes, patterns or configuration.

2. Description of the Related Art

A conventional floor pad structure in accordance with the prior art is disclosed in the Taiwanese Patent Publication No. 371874, comprising multiple rectangular floor pads. Two adjacent sides of each of the floor pads are formed with multiple insertion recesses, and the other two adjacent sides of each of the floor pads are formed with multiple insertion blocks. Thus, the multiple floor pads may be combined with each other by engagement of the insertion blocks and the insertion recesses, thereby assembling the entire floor pad structure. However, the conventional floor pad structure only has simple and monotonous patterns or figures, thereby decreasing the aesthetic quality of the floor pad structure.

SUMMARY OF THE INVENTION

The present invention has arisen to mitigate and/or obviate the disadvantage of the conventional floor pad structure.

The primary objective of the present invention is to provide a combination floor structure that may have variations of various shapes, patterns or configuration, thereby enhancing the aesthetic quality of the combination floor structure.

Another objective of the present invention is to provide a combination floor structure that may be assembled easily, simply and rapidly.

In accordance with the present invention, there is provided a combination floor structure, comprising multiple main boards, and multiple connecting boards, wherein:

each of the main boards is a rectangular plate, and has four corners each formed with a recessed portion, the recessed portion has a central position protruded with a locking lug, the locking lug has a center formed with a locking recess; and each of the connecting boards has an outer periphery formed with multiple connecting recesses each of which may allow insertion of the locking lug of the main board, so as to lock and position the locking lug of the main board, and each of the connecting recesses has a center protruded with a connecting lug that may be inserted into and locked in the locking recess of the main board.

Further benefits and advantages of the present invention will become apparent after a careful reading of the detailed description with appropriate reference to the accompanying drawings.

DETAILED DESCRIPTION OF THE INVENTION

Figure 1:
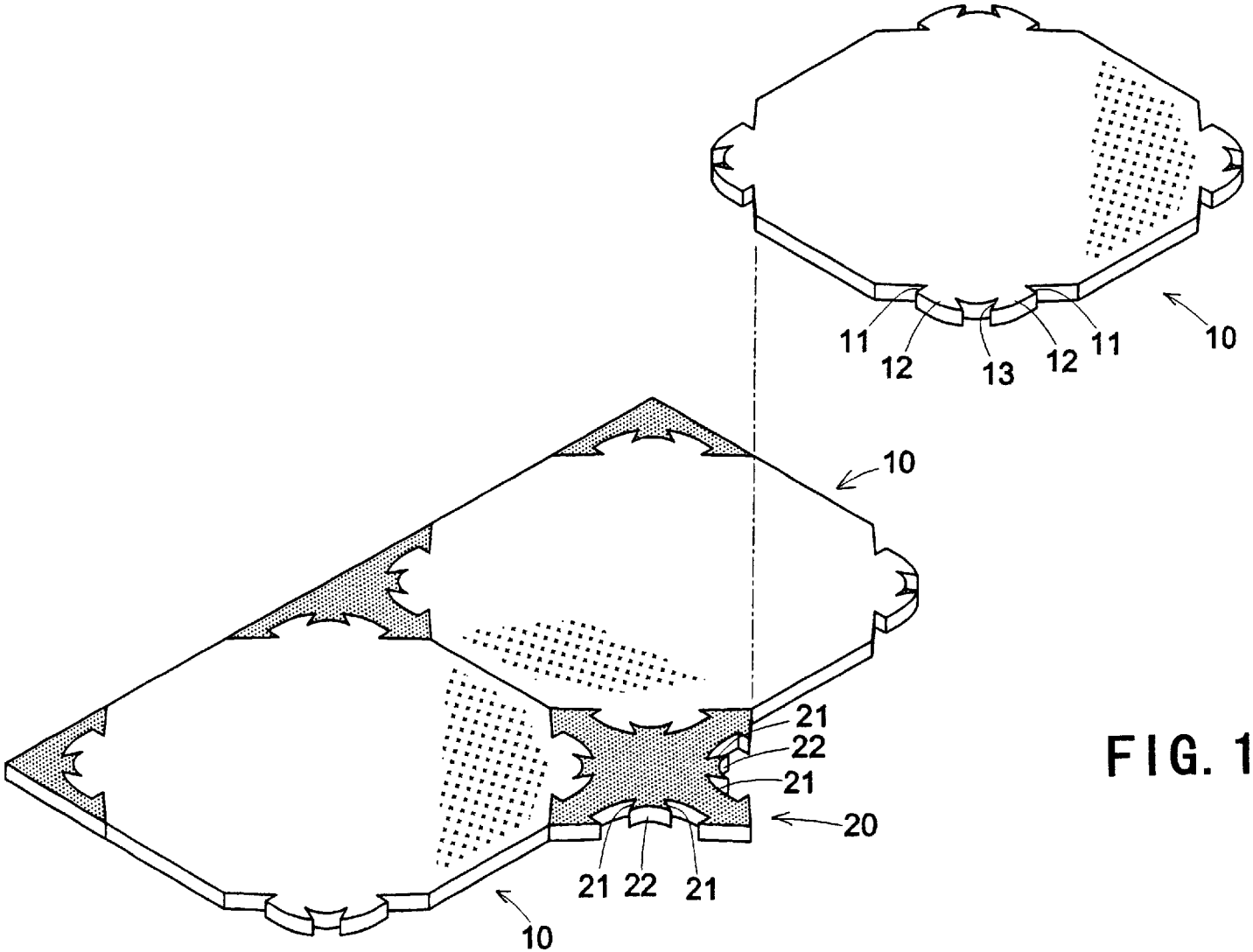
FIG. 1 is a partially exploded perspective view of a combination floor structure in accordance with a first embodiment of the present invention.
Figure 2:
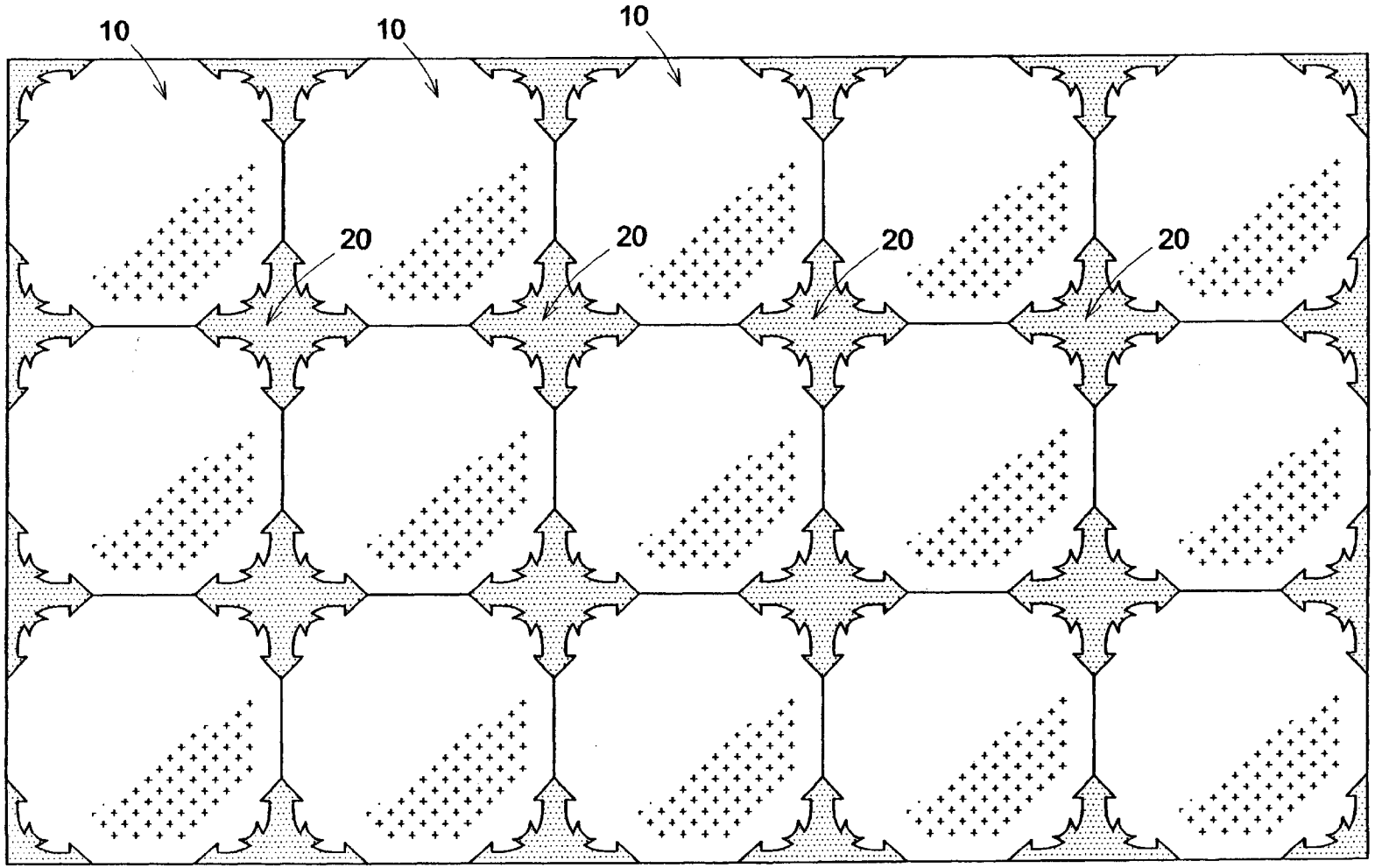
FIG. 2 is a plan assembly view of the combination floor structure as shown in FIG. 1.

Referring to the drawings and initially to FIGS. 1 and 2, a combination floor structure in accordance with a first embodiment of the present invention comprises multiple main boards 10, and multiple connecting boards 20.

Each of the main boards 10 is a rectangular plate, and has four corners each formed with a chamfered recessed portion 11. The recessed portion 11 has a central position protruded with a sector-shaped locking lug 12 as shown in FIG. 2. The locking lug 12 has a center formed with a dovetail-shaped locking recess 13.

Each of the connecting boards 20 is a rectangular plate to mate with the main board 10, and has four sides each formed with a connecting recess 21 for insertion of the locking lug 12 of the main board 10, so as to lock and position the locking lug 12 of the main board 10. The connecting recess 21 has a center protruded with a dovetail-shaped connecting lug 22 that may be relatively inserted into and locked in the locking recess 13 of the main board 10.

Thus, when the combination floor structure in accordance with a first embodiment of the present invention is assembled as shown in FIGS. 1 and 2, one connecting board 20 may be combined with four main boards 10, wherein the locking lug 12 of each of the main boards 10 may be inserted into and locked in the connecting recess 21 of the connecting board 20, and the connecting lug 22 of the connecting board 20 may be inserted into and locked in the locking recess 13 of each of the main boards 10, so that one connecting board 20 may used to connect four main boards 10. Thus, the connecting boards 20 and the main boards 10 may be combined with each other serially, thereby assembling the entire combination floor structure in accordance with a first embodiment of the present invention as shown in FIG. 2.

Figure 3:
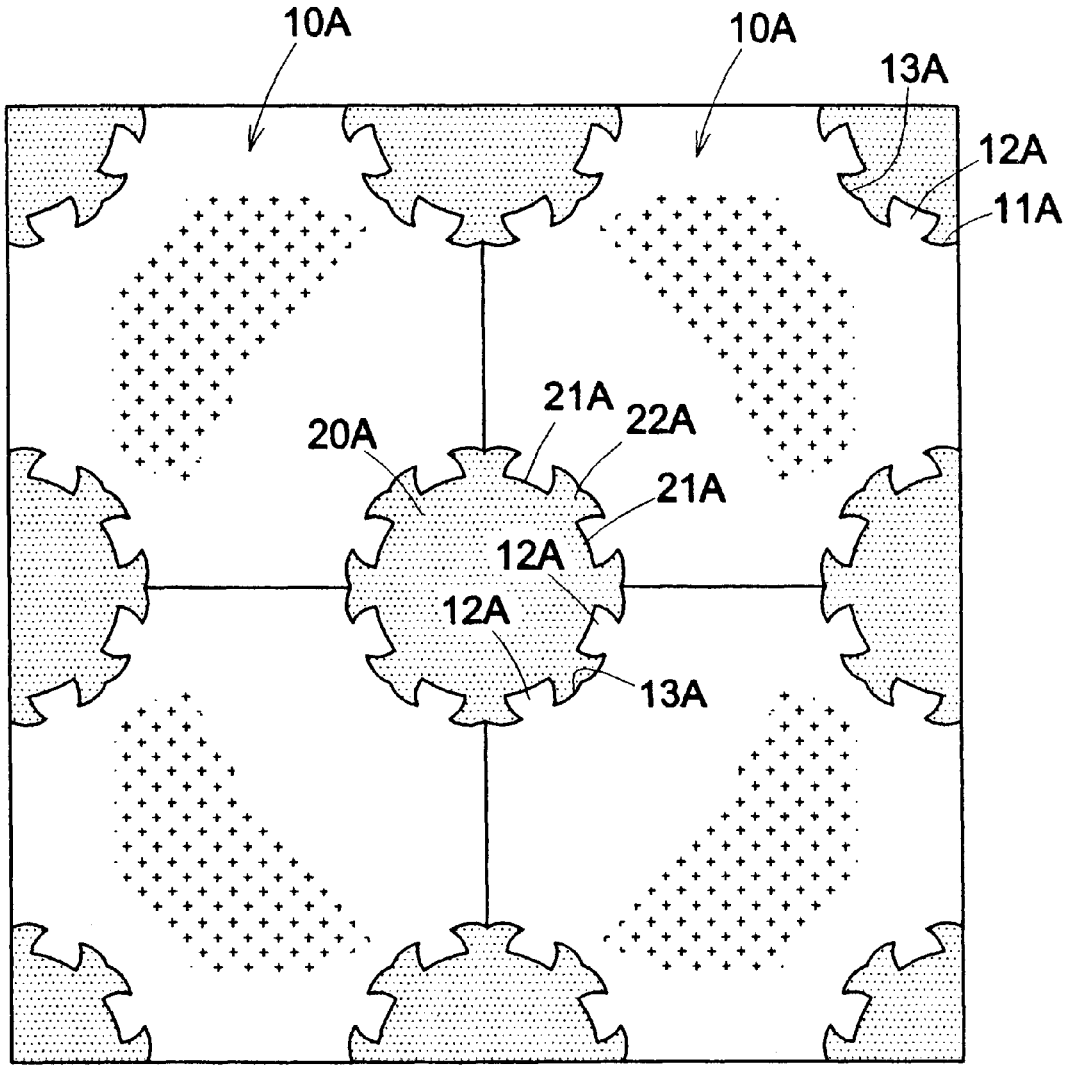
FIG. 3 is a plan assembly view of a combination floor structure in accordance with a second embodiment of the present invention.

Referring to FIG. 3, a combination floor structure in accordance with a second embodiment of the present invention comprises multiple main boards 10A, and multiple connecting boards 20A.

Each of the main boards 10A is a rectangular plate, and has four corners each formed with a chamfered recessed portion 11A. The recessed portion 11A has a central position protruded with a dovetail-shaped locking lug 12A. The locking lug 12A has a center formed with a dovetail-shaped locking recess 13A.

Each of the connecting boards 20A is a circular plate, and has an outer periphery formed with multiple dovetail-shaped connecting recesses 21A each of which may allow insertion of the locking lug 12A of the main board 10A, so as to lock and position the locking lug 12A of the main board 10A. Each of the connecting recesses 21A has a center protruded with a dovetail-shaped connecting lug 22A that may be relatively inserted into and locked in the locking recess 13A of the main board 10A.

Thus, when the combination floor structure in accordance with a second embodiment of the present invention is assembled as shown in FIG. 3, one connecting board 20A may be combined with four main boards 10A, wherein the locking lug 12A of each of the main boards 10A may be inserted into and locked in the connecting recess 21A of the connecting board 20A, and the connecting lug 22A of the connecting board 20A may be inserted into and locked in the locking recess 13A of each of the main boards 10A, so that one connecting board 20A may used to connect four main boards 10A. Thus, the connecting boards 20A and the main boards 10A may be combined with each other serially, thereby assembling the entire combination floor structure in accordance with a second embodiment of the present invention as shown in FIG. 3.

Figure 4:
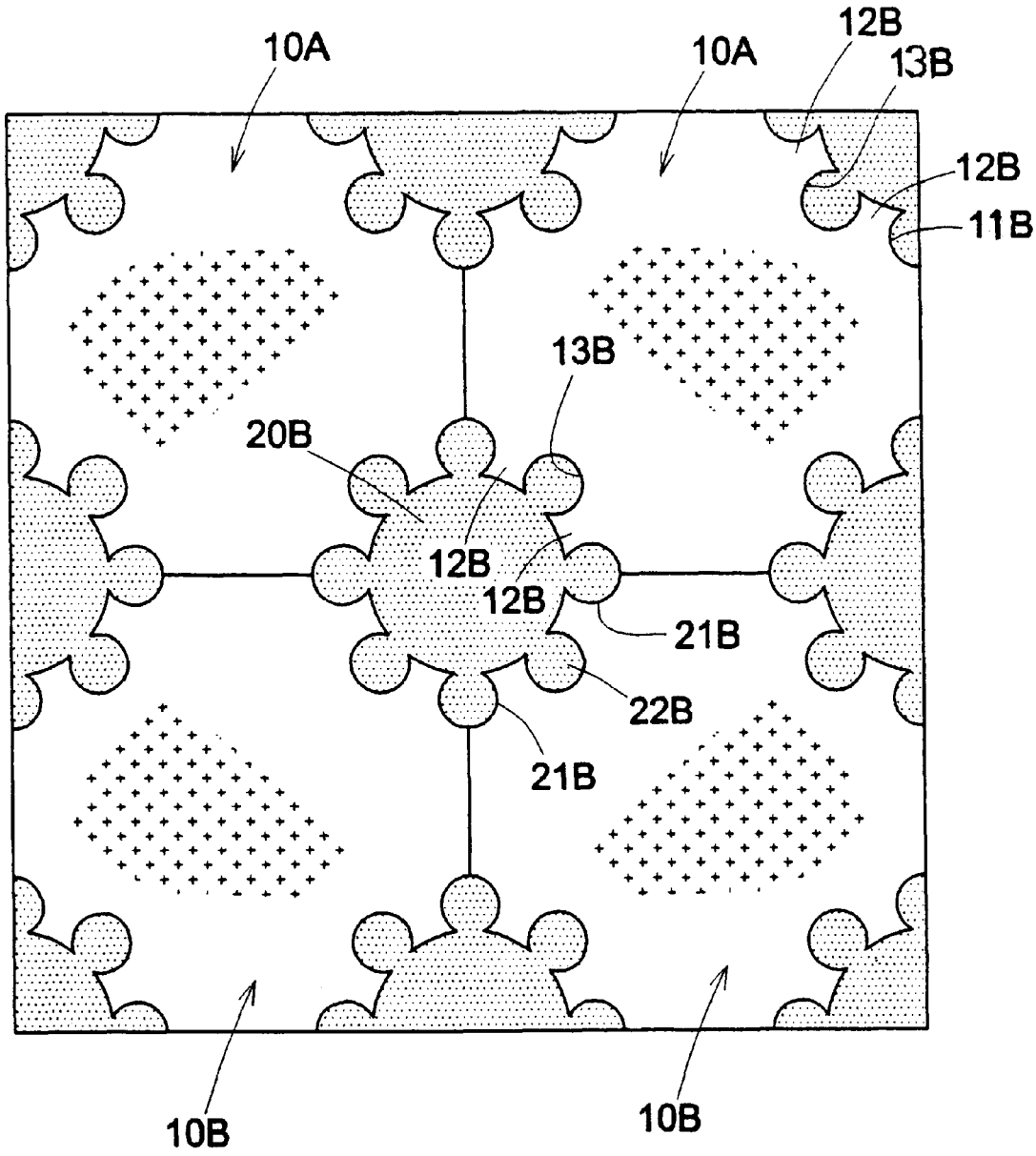
FIG. 4 is a plan assembly view of a combination floor structure in accordance with a third embodiment of the present invention.

Referring to FIG. 4, a combination floor structure in accordance with a third embodiment of the present invention comprises multiple main boards 10B, and multiple connecting boards 20B.

Each of the main boards 10B is a rectangular plate, and has four corners each formed with an arcuate recessed portion 11B. The recessed portion 11B has a central position protruded with a locking lug 12B. The locking lug 12B has a center formed with a substantially circular locking recess 13B which has an opening formed with an arcuate reduced neck.

Each of the connecting boards 20B is a circular plate, and has an outer periphery formed with multiple connecting recesses 21B each of which may allow insertion of the locking lug 12B of the main board 10B, so as to lock and position the locking lug 12B of the main board 10B. Each of the connecting recesses 21B has a center protruded with a substantially circular connecting lug 22B that may be relatively inserted into and locked in the locking recess 13B of the main board 10B.

Thus, when the combination floor structure in accordance with a third embodiment of the present invention is assembled as shown in FIG. 4, one connecting board 20B may be combined with four main boards 10B, wherein the locking lug 12B of each of the main boards 10B may be inserted into and locked in the connecting recess 21B of the connecting board 20B, and the connecting lug 22B of the connecting board 20B may be inserted into and locked in the locking recess 13B of each of the main boards 10B, so that one connecting board 20B may used to connect four main boards 10B. Thus, the connecting boards 20B and the main boards 10B may be combined with each other serially, thereby assembling the entire combination floor structure in accordance with a third embodiment of the present invention as shown in FIG. 4.

Accordingly, in accordance with the present invention, the connecting board may be used to connect the main boards, and may be designed to have different shapes, patterns and configurations, thereby enhancing the aesthetic quality of the combination floor structure of the present invention.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A combination floor structure, comprising multiple main boards, and multiple connecting boards, wherein:

each of the main boards is a rectangular plate, and has four corners each formed with a recessed portion, the recessed portion has a central position protruded with a locking lug, the locking lug has a center formed with a locking recess; and each of the connecting boards has an outer periphery formed with multiple connecting recesses each of which may allow insertion of the locking lug of the main board, so as to lock and position the locking lug of the main board, and each of the connecting recesses has a center protruded with a connecting lug that may be inserted into and locked in the locking recess of the main board.

2. The combination floor structure in accordance with claim 1, wherein each of the connecting boards is a rectangular plate.

3. The combination floor structure in accordance with claim 1, wherein the recessed portion of each of the four corners of each of the main boards is chamfered.

4. The combination floor structure in accordance with claim 1, wherein the locking recess of each of the main boards is dovetail-shaped.

5. The combination floor structure in accordance with claim 1, wherein the locking lug of each of the main boards is dovetail-shaped.

6. The combination floor structure in accordance with claim 1, wherein each of the connecting boards is a circular plate.

7. The combination floor structure in accordance with claim 1, wherein the recessed portion of each of the four corners of each of the main boards has an arcuate shape.

8. The combination floor structure in accordance with claim 1, wherein the locking recess of each of the main boards has a substantially circular shape, and has an opening formed with an arcuate reduced neck.

9. The combination floor structure in accordance with claim 1, wherein the connecting lug of each of the connecting recesses of each of the connecting boards has a substantially circular shape.

* * * * *